United States Patent [19]

Stotz et al.

[11] 4,116,763

[45] Sep. 26, 1978

[54] SEPARATING SYSTEM FOR WIRES OF A DOUBLE-WIRE PAPER-MAKING MACHINE

[75] Inventors: Wolf-Gunter Stotz; Herbert Holik, both of Ravensburg, Germany

[73] Assignee: Escher Wyss GmbH, Ravensburg, Wurtt., Germany

[21] Appl. No.: 757,139

[22] Filed: Jan. 6, 1977

[30] Foreign Application Priority Data

Jan. 19, 1976 [CH] Switzerland ..... 565/76

[51] Int. Cl.[2] ..... D21F 1/40

[52] U.S. Cl. ..... 162/301; 162/306

[58] Field of Search ..... 162/301, 306, 203

[56] References Cited

U.S. PATENT DOCUMENTS

| | | | |
|---|---|---|---|
| 3,565,757 | 2/1971 | Jordansson | 162/301 |
| 3,846,232 | 11/1974 | Kankaanpaa | 162/301 |
| 3,941,651 | 3/1976 | Koski | 162/301 |
| 3,985,612 | 10/1976 | Watanabe | 162/203 |

*Primary Examiner*—Richard V. Fisher

*Attorney, Agent, or Firm*—Kenyon & Kenyon, Reilly, Carr & Chapin

[57] ABSTRACT

The separator of the machine is constructed to retain the paper web on the inner (upper) wire upon separation of the two wires. To this end, the separator positions the roll for the outer (lower) wire downstream of the point of separation of the two wires. A suction box can be used in the separator roll to assist in retaining the paper web on the inner wire (FIG. 1). The inner wire extends from the separator along a straight run which defines an angle of less than 90° relative to the straight path traversed by the two wires upstream of the separator.

13 Claims, 2 Drawing Figures

SEPARATING SYSTEM FOR WIRES OF A DOUBLE-WIRE PAPER-MAKING MACHINE

Figure 1:
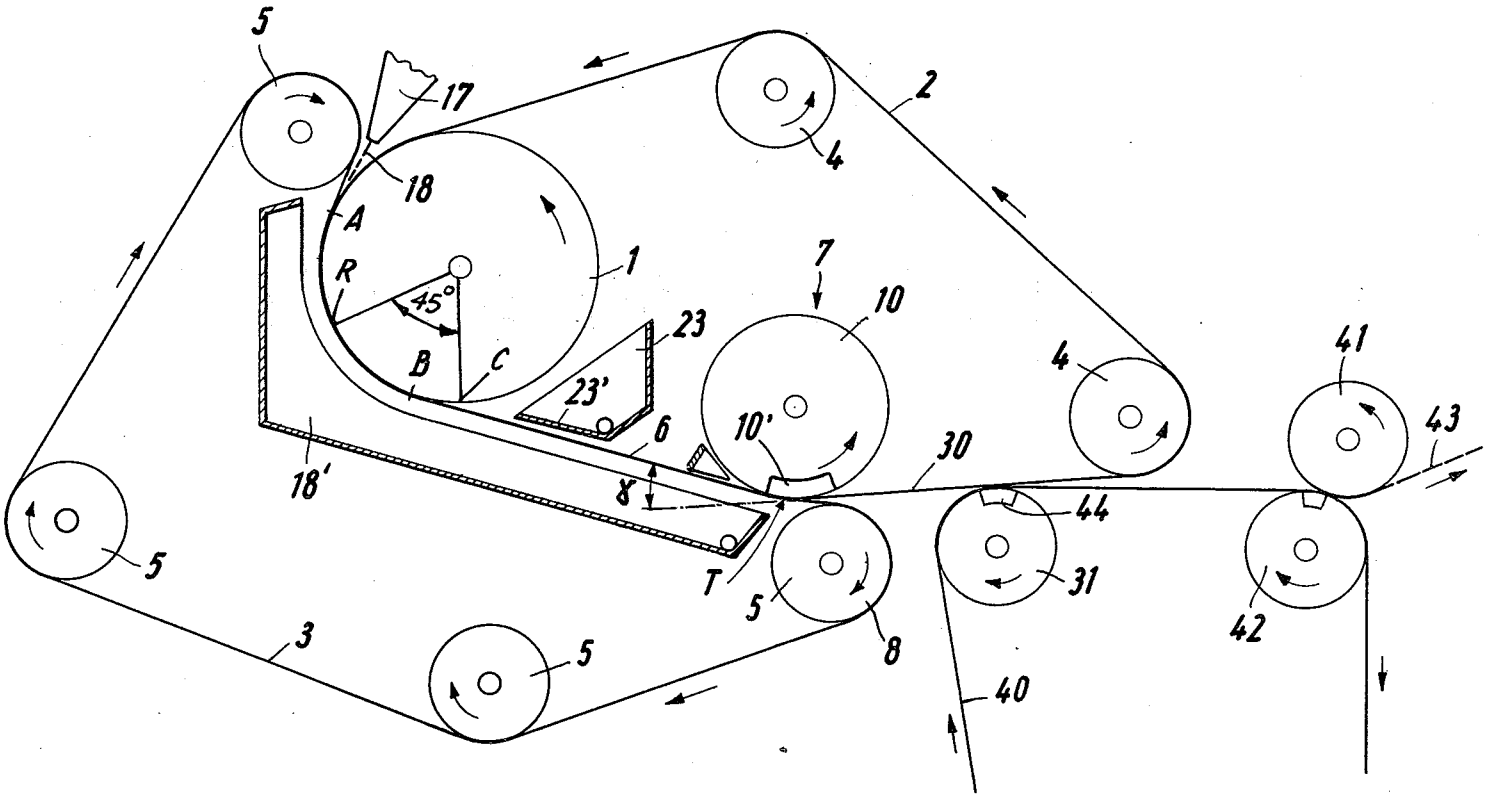

This invention relates to a double-wire paper-making machine. More particularly, this invention relates to a means of separating a paper web from the wires of a double-wire paper-making machine.

As is known, double-wire paper-making machines generally have two wires which are trained in endless loops over a directing roll and over guide rolls so as to extend together over some of the directing roll periphery from a place of engagement with the directing roll to a place of disengagement therefrom. In some instances, the plane of disengagement is disposed between the lowest part of the directing roll and a part which is offset by 45° from the lowest part in the direction towards the place of engagement. Further, the wires usually leave the directing roll together at the place of disengagement with one of the wires — the inner wire — extending around much of the directing roll. The wires are usually supplied in a substantially straight path to a separator after leaving the surface of the directing roll so as to be separated from one another. Such machines usually employ a head box for supplying bulk or furnish or stock or the like for forming a fleece or paper web between the wires.

A double-wire paper-making machine of the above kind is known, e.g., from U.S. Pat. No. 2,881,678. In the known machine, the paper web remains on the bottom (outer) wire after the place of separation. As a result, there are difficulties in transferring the web from the bottom (outer) wire to a subsequent drying or pressing facility.

Accordingly, it is an object of the invention to provide a double-wire paper-making machine wherein a paper web or fleece or the like which has been formed between two wires can be placed from above on a strip-like or band-like take-off or removing element, such as a dry wire or a felt, which is disposed after the paper-making machine.

It is another object of the invention to provide a double-wire paper-making machine wherein a paper web is retained on the upper wire after separation of the wires.

It is another object of the invention to facilitate the separation and drying of a paper web formed between two wires of a double-wire paper-making machine.

It is another object of the invention to transfer a paper web in a closed manner in order to obviate any self-supporting guidance of the paper web which still has a high water content and is mechanically delicate.

Briefly, the invention is directed to a double-wire paper-making machine which has a rotatable directing roll, a pair of forming wires of endless loop construction, a plurality of guide rolls which guide the wires in respective endless paths, and a head box for supplying stock between the wires to form a paper web. Such a machine is provided with a separator downstream of the directing roll for separating the wires from each other with the paper web on the inner wire. In addition, a take-off means is provided downstream of the separator for removing the paper web from the wire.

The forming wires extend along a periphery of the directing roll from a place of engagement to a place of disengagement with the place of dis-engagement being disposed between the lowest point of the roll and a point offset by 45° from the lowest point in a direction towards the place of engagement. The guide rolls guide the wires such that one wire (i.e., the inner wire) is guided around much of the directing roll and both wires are guided in a straight path downstream of the place of dis-engagement on the directing roll.

A paper-making machine which is constructed in the above manner is usually advantageous with respect to the further processing of the web or fleece and the necessary drying facility of the machine. In the simplest case, an additional felt or similar web or the like which would otherwise be necessary to change the position of the paper web or fleece can be omitted.

The inner wire has a straight portion or run downstream of the separator which forms an angle of less than 90° with that path of the wire disposed upstream of the separator, the straight run extending beyond the other wire. This feature facilitates the placing of the take-off means and the further guiding of the paper web, since no disturbance is caused by the other outer wire.

In this event, the take-off means can be disposed on the straight run which follows the separator. This feature is advantageous particularly in cases in which the paper web is transformed to a felt or similar band or belt or the like which extends substantially horizontally.

In one embodiment, a deflecting roller over which the inner wire is trained is disposed at the end of the straight run, and the take-off means is disposed at the deflecting roll or at the wire portion following the deflecting roll. This feature is advantageous particularly in cases in which the take-off or removing belt of the take-off means has a substantial vertical component. In such a case, the deflecting roll can include a suction device. This not only discourages disengagement of the paper web from the inner wire by centrifugal force but also has some dewatering effect.

The separator can include a suction roll. The effect of this is that the paper web is retained unequivocally and without disturbance in operation on the inner wire. This also provides some dewatering of the paper web.

However, the separator can comprise two cooperating rolls, over each of which one of the wires is trained, the roller over which the inner wire is trained being disposed at the place of separation of the two wires, while the second roll over which the other wire is trained is disposed after such place. This separator, as described in U.S. patent application Ser. No. 728,591 filed Oct. 1, 1976, now U.S. Pat. No. 4,071,401, also has the advantage of consuming less power than a suction device.

The take-off means can also include a suction means. Satisfactory take-off operation can then be provided. However, of course, take-off without any suction means, e.g., using a felt, is possible.

A suction means for retaining the paper web on the inner wire can be provided on the straight path of the wire between the separator and the take-off means or deflecting roll.

Figure 2:
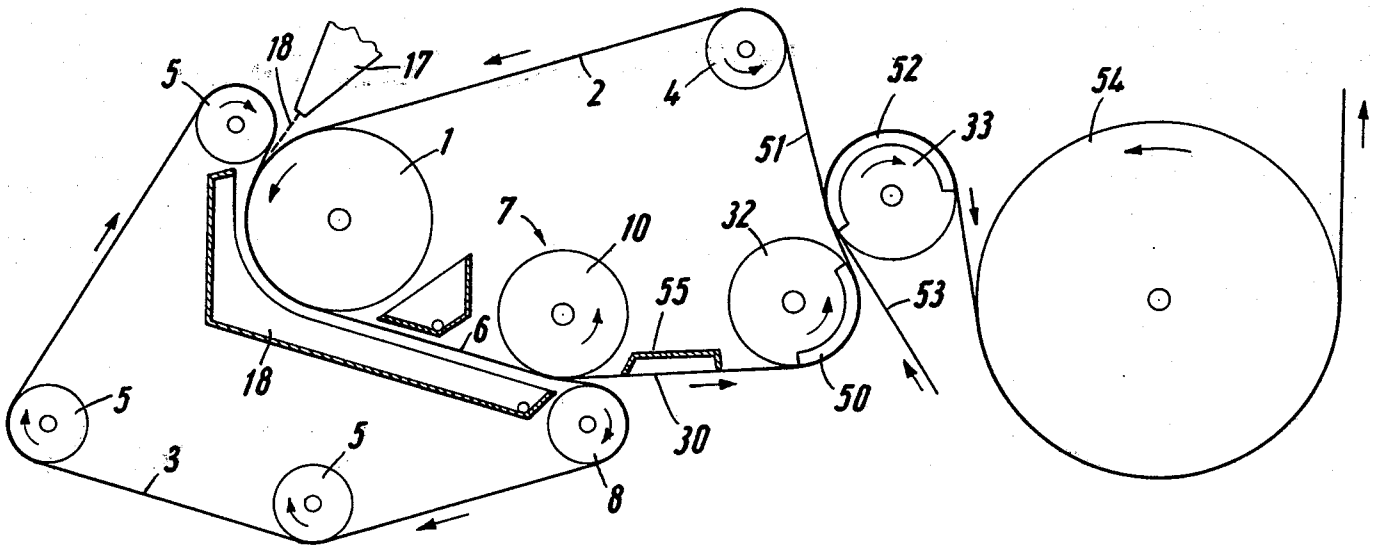

These and other objects and advantages of the invention will become more apparent from the following detailed description and appended claims taken in conjunction with the accompanying drawings in which:

FIG. 1 illustrates a double-wire paper-making machine according to the invention; and FIG. 2 illustrates a modified double-wire paper making machine according to the invention.

Referring to FIG. 1, the double-wire paper-making machine has a rotatable directing roll 1 over which an inner forming wire 2 and an outer forming wire 3 are trained. The wires 2, 3 are in the form of endless loop construction and extend along a periphery of the roll 1 from a place of engagement A to a place of dis-engagement B. This place of disengagement B is disposed between the lowest point C of the roll 1 and a point R offset by 45° from the lowest point in a direction towards the place of engagement A.

As shown, guide rolls 4, 5 guide the wires 2, 3 in respective endless paths. The inner wire 2 is guided around much of the directing roll 1 while both wires 2, 3 are guided in a straight path 6 downstream of the dis-engagement place B. This path extends to a separator 7 having a separation place or station T for separating the wires 2, 3 from each other.

The separator 7 includes two rolls 8, 10 with one roll 8 acting as a guide roll for the outer wire 3. The two rolls 8, 10 can be imperforate; however, the roll 10 can be a suction roll, in which event a suction box 10' can be included therein.

As shown, a head box 17 is disposed above the roll 1 and forms a stream 18 of pulp or stock or furnish or the like which is directed into a wedge-shaped gap or bight between the wires 2, 3 before the engagement place A. A tank 18' for collecting water separated out of the paper web is disposed below the roll 1. Also, a collecting tank 23 is disposed over the wire path 6 downstream of the roll 1 to collect water sprayed up from the wire 2 near the dis-engagement place B. In order to assist collection of water by the tank 23, the wires 2, 3 extend at a downward inclination in the path 6 so that the tank 23 can have an inclined bottom wall 23'. As can be gathered from U.S. Pat. No. 2,881,678, the tank 23 can collect water sprayed up by the roll 1 even when the wires 2, 3 extend horizontally.

The outer wire 3 is trained around the roll 8 and runs to the left in the drawings downstream of the separator 7. The inner wire 2 has a straight run or portion 30 which extends from the separator 7 above and beyond the outer wire 3 and which forms an angle δ of less than 45° with the path 6.

In the embodiment shown in FIG. 1, a take-off means is disposed downstream of the separator 7 to remove the paper web from the bottom of the inner wire 2. This take-off means employs a take-off or removing roll 31 which is disposed on and under a flat portion 30 of the inner wire 2 and over which a pressing felt 40 is trained. The felt 40 conveys the fleece between two rolls 41, 42 of a felt press. After passing therethrough, the paper web 43 is removed from the roll 41.

In order to assist the transfer of the paper web from the inner wire 3 to the pressing felt 40, the take-off roll 31 can be a suction roll, a feature indicated in FIG. 1 by a suction box 44 shown in diagrammatic form.

Referring to FIG. 2, wherein like reference characters indicate like parts as above, in order to improve the adhesion of the paper web or fleece to the inner wire 2, the machine can be provided with a deflecting roll 32 at the end of the flat, i.e., substantially horizontal portion 30 of the inner wire 2 extending from the separator 7. The roll 32 takes the form of a suction roller which includes a suction box 50.

As shown, the inner wire 2 has a steeply rising portion 51 in which a take-off or removing roll 33 acts on the wire 2. The roll 33, which can have a suction box 52, has a drying wire 53 trained thereover which wire 53 supplies the paper web to a drying roll 54. The wire 53 is trained, in known manner, over guide rolls (not shown). After drying on the drying roll 54 and possibly other subsequent drying rolls, the paper web is removed from the drying wire 53 in a manner which is known and not shown.

As viewed in FIG. 2, the straight portion 30 of the wire 2 between the separator 7 and take-off means can have a suction box 55 which prevents detachment of the paper web in the portion 30 and also helps in dewatering.

What is claimed is:

1. A double wire paper-making machine comprising a rotatable directing roll;

a pair of forming wires of endless loop construction extending along a periphery of said roll from a place of engagement to a place of dis-engagement, said place of disengagement being disposed between the lowest point of said roll and a point offset by 45° from said lowest point in a direction towards said place of engagement;

a plurality of guide rolls guiding said wires in respective endless paths, one of said wires being guided around much of said directing roll and both said wires being guided in a straight path downstream of said dis-engagement place;

a head box upstream of said directing roll for supplying stock between said wires to form a paper web therebetween;

a separator downstream of said directing roll for separating said wires from each other with the paper web on the bottom of said one wire; and a take-off means downstream of said separator for removing the paper web from the bottom of said one wire, wherein said one wire extends from said separator and from said straight path along a straight run at an angle of less than ninety degrees relative to said straight path, said one wire extending away from the other wire in said straight run.

2. A double wire paper-making machine as set forth in claim 1 which further comprises a suction means between said separator and said take-off means for retaining the paper web on said one wire.

3. A double wire paper-making machine as set forth in claim 1 wherein said take-off means is disposed on and under said straight run.

4. A double wire paper-making machine as set forth in claim 1 which further comprises a deflecting roll within the endless path of said one wire at a downstream end of said straight run, said one wire being disposed over said deflecting roll and said take-off means being disposed at said deflecting roll.

5. A double wire paper-making machine as set forth in claim 4 wherein said deflecting roll includes a suction means for retaining the paper web on said one wire.

6. A double wire paper-making machine as set forth in claim 5 which further comprises a suction means between said separator and said deflecting roll for retaining the paper web on said one wire.

7. A double wire-paper making machine as set forth in claim 1 wherein said separator is a suction roll.

8. A double wire paper-making machine as set forth in claim 1 wherein said separator includes a pair of rolls, one of said rolls having said one wire trained thereon at a point of separation of said wires from each other, and the other of said rolls having the other of said wires trained thereon and being disposed downstream of said point of separation.

9. A double wire paper-making machine as set forth in claim 1 wherein said take-off means includes a suction means.

10. A double wire paper-making machine comprising a rotatable directing roll;

a pair of forming wires of endless loop construction extending along a periphery of said roll from a place of engagement to a place of dis-engagement, said place of disengagement being disposed between the lowest point of said roll and a point offset by 45° from said lowest point in a direction towards said place of engagement;

a plurality of guide rolls guiding said wires in respective endless paths in trained relation over said directing roll;

a head box upstream of said directing roll for supplying stock between said wires to form a paper web therebetween;

a separator downstream of said directing roll for separating said wires from each other with an inner one of said wires extending from said separator in a straight run above and beyond the other of said wires with the paper web on the bottom of said inner wire; and a take-off means downstream of said separator for removing the paper web from the bottom of said inner wire.

11. A double wire paper-making machine as set forth in claim 10 wherein said guide rolls guide said wires in a straight path between said directing roll and said separator, and said straight run is substantially horizontal and forms an angle of less than 45° relative to said straight path.

12. A double wire paper-making machine as set forth in claim 11 wherein said take-off means is disposed on said straight run.

13. A double wire paper-making machine as set forth in claim 10 wherein said separator includes a pair of rolls, one of said rolls having said inner wire disposed thereon at a point of separator of said wires from each other, and the other of said rolls having said outer wire trained thereabout and being disposed downstream of said point of separation.

* * * * *

UNITED STATES PATENT AND TRADEMARK OFFICE

CERTIFICATE OF CORRECTION

PATENT NO. : 4,116,763
DATED : September 26, 1978

INVENTOR(S) : Wolf-Gunter Stotz and Herbert Holik

It is certified that error appears in the above-identified patent and that said Letters Patent are hereby corrected as shown below:

Column 1, line 15 change "plane" to --place--

Column 6, line 18 change "separator" to --separation--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*